US008976970B2

(12) United States Patent
Kim et al.

(10) Patent No.: US 8,976,970 B2
(45) Date of Patent: Mar. 10, 2015

(54) APPARATUS AND METHOD FOR BANDWIDTH EXTENSION FOR MULTI-CHANNEL AUDIO

(75) Inventors: Mi Young Kim, Hwaseong (KR); Ki Hyun Choo, Seoul (KR); Eun Mi Oh, Seoul (KR); Boris Kudryashov, St. Petersburg (RU); Kirill Yurkov, St. Petersburg (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 449 days.

(21) Appl. No.: 13/232,696

(22) Filed: Sep. 14, 2011

(65) Prior Publication Data

US 2012/0070007 A1 Mar. 22, 2012

(30) Foreign Application Priority Data

Sep. 16, 2010 (KR) ..... 10-2010-0091040

(51) Int. Cl.

| | |
|---|---|
| ***H04R 5/00*** | (2006.01) |
| ***G10L 19/008*** | (2013.01) |
| ***H04S 3/00*** | (2006.01) |
| ***G10L 21/038*** | (2013.01) |

(52) U.S. Cl.

CPC ..... *H04S 3/008* (2013.01); *G10L 21/038* (2013.01); *G10L 19/008* (2013.01); *H04S 2400/03* (2013.01); *H04S 2420/03* (2013.01); *H04S 2420/07* (2013.01)

USPC ..... 381/22; 381/23; 704/500

(58) Field of Classification Search

USPC ..... 381/22, 23; 704/500

See application file for complete search history.

(56) References Cited

U.S. PATENT DOCUMENTS

| | | | | |
|---|---|---|---|---|
| 8,170,882 | B2 * | 5/2012 | Davis | 381/307 |
| 2006/0133618 | A1 * | 6/2006 | Villemoes et al. | 381/20 |
| 2007/0239442 | A1 * | 10/2007 | Hotho et al. | 704/226 |
| 2008/0033732 | A1 * | 2/2008 | Seefeldt et al. | 704/500 |
| 2008/0077412 | A1 * | 3/2008 | Oh et al. | 704/500 |
| 2008/0120095 | A1 * | 5/2008 | Oh et al. | 704/203 |
| 2008/0205658 | A1 * | 8/2008 | Breebaart | 381/17 |
| 2008/0253576 | A1 * | 10/2008 | Choo et al. | 381/10 |
| 2008/0255859 | A1 * | 10/2008 | Jung et al. | 704/500 |
| 2008/0270124 | A1 * | 10/2008 | Son et al. | 704/205 |
| 2009/0037180 | A1 * | 2/2009 | Kim et al. | 704/500 |
| 2009/0043591 | A1 * | 2/2009 | Breebaart et al. | 704/500 |
| 2009/0110203 | A1 * | 4/2009 | Taleb | 381/17 |
| 2009/0157411 | A1 * | 6/2009 | Kim et al. | 704/500 |
| 2009/0164221 | A1 * | 6/2009 | Kim et al. | 704/500 |
| 2009/0164222 | A1 * | 6/2009 | Kim et al. | 704/500 |

(Continued)

FOREIGN PATENT DOCUMENTS

| | | | |
|---|---|---|---|
| EP | 2 144 231 | A1 | 1/2010 |
| KR | 10-2007-0107615 | A | 11/2007 |

(Continued)

*Primary Examiner* — Duc Nguyen
*Assistant Examiner* — Yogeshkumar Patel
(74) *Attorney, Agent, or Firm* — NSIP Law

(57) ABSTRACT

A method and apparatus of effectively encoding and decoding a high-frequency signal of a multi-channel audio are provided. A multi-channel audio decoding apparatus may down-mix a multi-channel audio input signal, expand a number of channels of the down-mixed signal, select at least one of the expanded channel signal, extract a parameter indicating a characteristic relation between the selected signal and the multi-channel audio input signal, and encode the down-mixed signal and the extracted parameter.

13 Claims, 4 Drawing Sheets

(56) References Cited

U.S. PATENT DOCUMENTS

| | | | | |
|---|---|---|---|---|
| 2009/0172060 | A1* | 7/2009 | Taleb et al. | 708/322 |
| 2009/0210234 | A1* | 8/2009 | Sung et al. | 704/500 |
| 2010/0114583 | A1 | 5/2010 | Lee et al. | |
| 2011/0002470 | A1* | 1/2011 | Purnhagen et al. | 381/23 |
| 2011/0051935 | A1* | 3/2011 | Moon et al. | 381/1 |
| 2011/0173005 | A1* | 7/2011 | Hilpert et al. | 704/500 |
| 2011/0196685 | A1* | 8/2011 | Kim et al. | 704/500 |
| 2011/0249821 | A1* | 10/2011 | Jaillet et al. | 381/22 |
| 2013/0094654 | A1* | 4/2013 | Breebaart et al. | 381/22 |

FOREIGN PATENT DOCUMENTS

| | | | |
|---|---|---|---|
| KR | 10-2008-0027129 | A | 3/2008 |
| WO | WO 2009/066960 | A1 | 5/2009 |
| WO | WO 2010070225 | A1 * | 6/2010 |

* cited by examiner

APPARATUS AND METHOD FOR BANDWIDTH EXTENSION FOR MULTI-CHANNEL AUDIO

CROSS-REFERENCE TO RELATED APPLICATION(S)

This application claims the benefit under 35 U.S.C. §119(a) of Korean Patent Application No. 10-2010-0091040, filed on Sep. 16, 2010, in the Korean Intellectual Property Office, the entire disclosure of which is incorporated herein by reference for all purposes.

BACKGROUND

1. Field

The following description relates to a method of encoding and decoding a multi-channel audio, and more particularly, to a method and apparatus of encoding and decoding a high-frequency signal of the multi-channel audio.

2. Description of Related Art

Multi-channel audio coding schemes may generally include a waveform multi-channel audio coding scheme and a parametric multi-channel audio coding scheme.

The waveform multi-channel audio coding scheme may be classified as a moving picture expert group (MPEG)-2 multi channel extension (MC) audio coding scheme, an advanced audio coding (AAC) MC audio coding scheme, a bit sliced arithmetic coding/audio video standard MC (BSAC/AVS MC) audio coding scheme, and the like.

The parametric multi-channel audio coding scheme may include an MPEG surround scheme, and the MPEG surround scheme may restore a multi-channel audio signal using a downmixed signal and spatial information.

The MPEG surround scheme may down-mix the multi-channel audio signal and parameterize the spatial information to compress the multi-channel audio signal, and may restore the multi-channel audio signal with only a small amount of information. The MPEG-surround scheme may be used together with a Spectral Band Replication (SBR) coding scheme to increase compression efficiency.

SUMMARY

In one general aspect there is provided a multi-channel audio signal encoding apparatus including a downmixer configured to downmix a multi-channel audio input signal, a channel decorrelator configured to expand a number of channels of the downmixed signal thereby providing an expanded channel signal, a parameter estimator configured to select at least one signal from among the expanded channel signal, and to extract a parameter indicating a characteristic relation between the selected signal and the multi-channel audio input signal and a bitmuxer configured to encode the downmixed signal and the extracted parameter.

The channel decorrelator may expand the number of channels of the downmixed signal through linear combination or decorrelation.

The bitmuxer may encode the extracted parameter and a signal associated with a high frequency band signal of the multi-channel audio input signal from among the downmixed signal.

The parameter estimator may select, from among the downmixed signal and the expanded channel signal, at least one signal having a maximal value when a match function is applied to the downmixed signal and the expanded channel signal with each input signal of the multi-channel audio input signal, and extracts a parameter indicating a characteristic relation between the selected signal and the multi-channel audio input signal.

In another aspect, there is provided a multi-channel audio signal decoding apparatus including a bitdemuxer configured to restore, from an input bitstream that is obtained by encoding a multi-channel audio signal, a downmixed signal of the multi-channel audio signal, a parameter decoder configured to restore, from the input bit stream, a parameter to be used for restoring a channel signal included in the multi-channel audio signal, and a channel decorrelator configured to expand a number of channels of the restored downmixed signal. The multi-channel audio decoding apparatus further includes a high-frequency signal synthesizer configured to select, from the downmixed signal of which the number of channels is expanded, a channel signal to be patched using the restored parameter and a spatial synthesizer configured to restore the channel signal included in the multi-channel audio signal using the selected channel signal and the restored parameter information.

The channel decorrelator may expand the number of channels of the downmixed signal, through linear combination or decorrelation.

In another aspect, there is provided a multi-channel audio signal encoding method of a transmitter including downmixing a multi-channel audio input signal, expanding a number of channels of the downmixed signal, selecting at least one signal from among the expanded channel signal, extracting a characteristic relation between the selected signal and the multi-channel audio input signal, and encoding the downmixed signal and the extracted parameter.

The expanding may include expanding the number of channels of the downmixed signal through linear combination or decorrelation.

The encoding may include encoding the extracted parameter and a signal associated with a high frequency band signal of the multi-channel audio input signal from among the downmixed signal.

The selecting and extracting may include selecting, from among the downmixed signal and the expanded channel signal, at least one signal having a maximal value when a match function is applied to the downmixed signal and the expanded channel signal with each input signal of the multi-channel audio input signal and extracting a parameter indicating a characteristic relation between the selected signal and the multi-channel audio input signal.

A non-transitory computer readable storage medium may store a program to implement the multi-channel audio encoding method.

In another aspect there is provided a multi-channel audio signal decoding method of a receiver including restoring, from an input bitstream that is obtained by encoding a multi-channel audio signal, a downmixed signal of the multi-channel audio signal, restoring, from the input bitstream, a parameter to be used for restoring a channel signal included in the multi-channel audio signal, expanding a number of channels of the restored downmixed signal, selecting, from the downmixed signal of which the number of channels is expanded, a channel signal to be patched using the restored parameter, and restoring the channel signal included in the multi-channel audio signal using the selected channel signal and the restored parameter information.

The expanding may include expanding the number of channels of the downmixed signal through linear combination or decorrelation.

In still another general aspect, there is provided a transmitter having a multi-channel audio signal encoding apparatus, the multi-channel audio signal encoding apparatus including a downmixer configured to downmix a multi-channel audio input signal received at the transmitter and a channel decorrelator configured to expand a number of channels of the downmixed signal thereby providing an expanded channel signal. The encoding apparatus further includes a parameter estimator configured to select at least one signal from among the expanded channel signal, and to extract a parameter indicating a characteristic relation between the selected signal and the multi-channel audio input signal and a bitmuxer configured to encode the downmixed signal and the extracted parameter. The transmitter transmits the encoded downmixed signal and extracted parameter.

In another general aspect, there is provided a receiver having a multi-channel audio signal decoding apparatus, the multi-channel audio signal decoding apparatus including a bitdemuxer configured to restore, from an input bitstream that is obtained by encoding a multi-channel audio signal, a downmixed signal of the multi-channel audio signal, a parameter decoder configured to restore, from the input bit stream, a parameter to be used for restoring a channel signal included in the multi-channel audio signal, and a channel decorrelator configured to expand a number of channels of the restored downmixed signal. The signal decoding apparatus further includes a high-frequency signal synthesizer configured to select, from the downmixed signal of which the number of channels is expanded, a channel signal to be patched using the restored parameter and a spatial synthesizer configured to restore the channel signal included in the multi-channel audio signal using the selected channel signal and the restored parameter information.

Other features and aspects may be apparent from the following detailed description, the drawings, and the claims.

Figure 1:
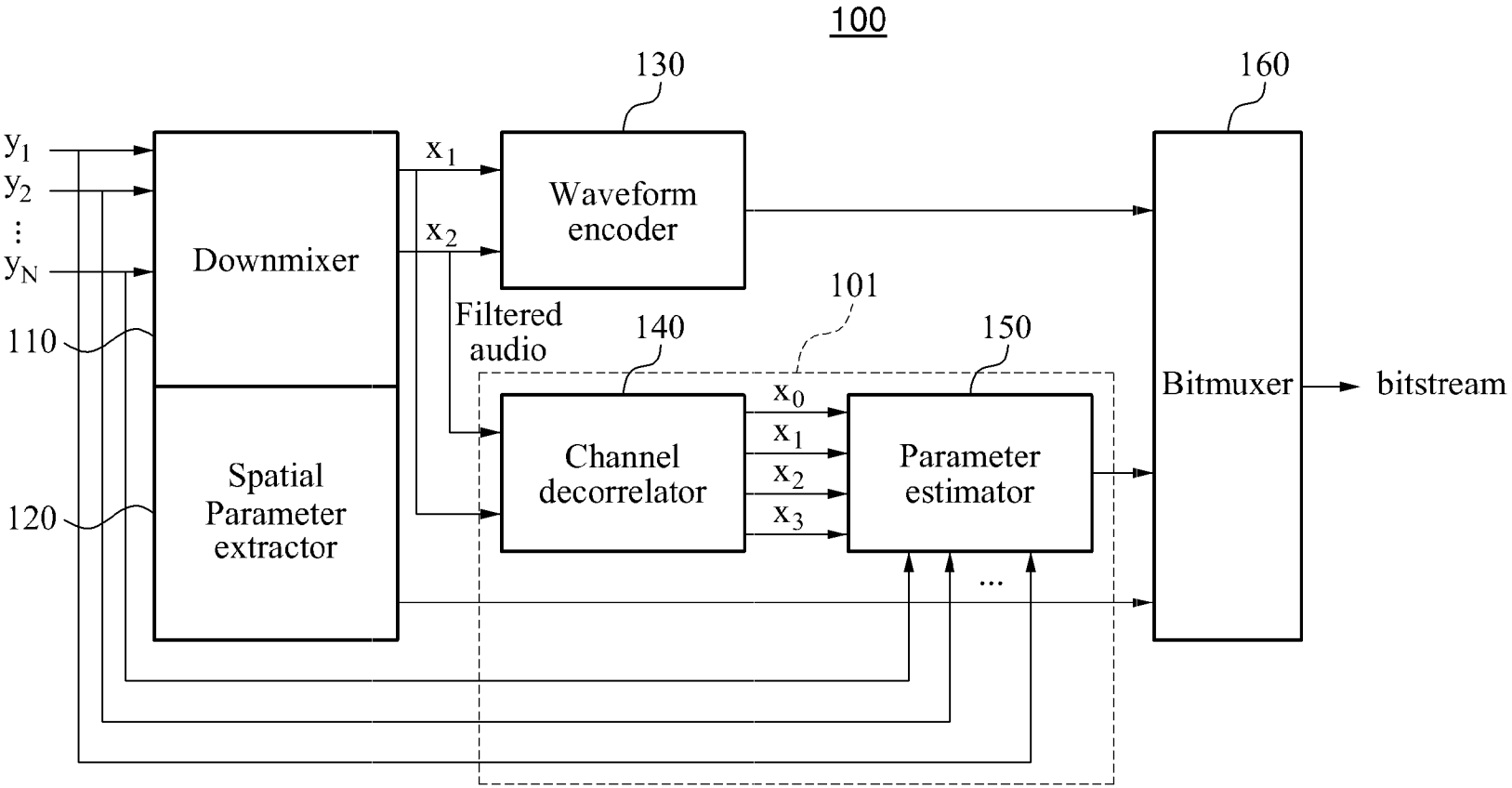
FIG. 1 is a diagram illustrating an example of a multi-channel audio signal encoding apparatus.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses and/or methods described herein may be suggested to those of ordinary skill in the art. Also, descriptions of well-known functions and constructions may be omitted for increased clarity and conciseness.

FIG. 1 illustrates an example of a multi-channel audio signal encoding apparatus 100. The multi-channel audio signal encoding apparatus may be implemented in a transmitter.

In this example, multi-channel signals $y_1, y_2, \ldots, y_N$ are inputted to a downmixer 110.

The downmixer 110 down-mixes, based on a moving picture expert group (MPEG) surround scheme, the multi-channel signals into 2-channel signals $x_1$ and $x_2$.

A spatial parameter extractor 120 expresses low frequency band signals of the multi-channel signals $y_1, y_2, \ldots, y_N$ by spatial parameters indicating spatial correlations between channels.

A channel decorrelator 140 generates additional signals $x_3$, $x_4$, and the like by expanding channels using high frequency band signals of the downmixed signals $x_1$ and $x_2$, and may generate base signal sets.

The parameter estimator 150 generates parameters corresponding to envelopes of the high frequency band signals, based on correlation between signals $x_1$, $x_2$, $x_3$, $x_4$, and the like corresponding to the base signal sets and high-frequency band signals of the inputted multi-channel signals $y_1$, $y_2, \ldots, y_N$.

The above described process will be described with reference to the examples in FIGS. 1 through 3.

In the process, when high-frequency band signals corresponding to a $j^{th}$ subband of the inputted multi-channel signals $y_1, y_2, \ldots, y_N$ is $Y_0^j, Y_1^j, Y_2^j, Y_3^j, Y_4^j$, downmixed signals $X_0^j$ and $X_1^j$ may be calculated as expressed by Equation 1.

$$\begin{cases} X_0^j = Y_0^j + Y_1^j + Y_2^j \\ X_1^j = Y_3^j + Y_4^j - Y_2^j \end{cases} \quad \text{[Equation 1]}$$

In Equation 1, the downmixed signals) $X_0^j$ and $X_1^j$ are calculated in the same manner as a downmixing process based on an MPEG surround scheme.

The high frequency signals may be restored based on a conventional Spectral Band Replication (SBR) coding scheme.

High-frequency signals $X_2^j$ and $X_3^j$ that are additionally generated based on the downmixed signals $X_0^j$ and $X_1^j$ are calculated as expressed by Equation 2.

$$\begin{cases} X_2^j = 0.5 \cdot (X_0^j - X_1^j) \\ X_3^j = X_0^j + X_1^j \end{cases} \quad \text{[Equation 2]}$$

In Equation 2, the additional high-frequency signals $X_2^j$ and $X_3^j$ may be generated by the channel decorrelator 140.

The base signal sets that are generated after the additional high-frequency signals are generated are expressed below in Equation 3.

$$\begin{cases} X_0^j = Y_0^j + Y_1^j + Y_2^j \\ X_1^j = Y_3^j + Y_4^j - Y_2^j \\ X_2^j = Y_2^j + 0.5 \cdot (Y_0^j + Y_1^j - Y_3^j - Y_4^j) \\ X_3^j = Y_0^j + Y_1^j + Y_3^j + Y_4^j \end{cases} \quad \text{[Equation 3]}$$

In Equation 3, signals $X_0^j$, $X_1^j$, $X_2^j$ and $X_3^j$ are candidate values for an optimal signal to be used for extracting the parameters indicating a characteristic relation between the multi-channel audio input signals and a signal selected by the parameter estimator 150.

The high-frequency signals of the multi-channel signals may be restored by selecting a signal to be patched from signals $X_0^j$, $X_1^j$, $X_2^j$, and $X_3^j$, and in the same manner as selecting a signal to be patched from a low frequency signal during a bandwidth extension process.

The high frequency signals of the multi-channel signals may be restored by selecting, from among the signals, a signal that is most similar to a high frequency signal of an original signal.

In this example, the parameter estimator 150 selects an optimal signal from among the expanded channel signals.

The optimal signal may be a channel signal having a maximal value among the downmixed signals and the expanded channel signals, when a match function is applied to the downmixed signals and the expanded channel signals with each input signal of the multi-channel signals.

As for and $X_0^j$, $X_1^j$, $X_2^j$, and $X_3^j$, a characteristic of a signal $(Y_0^j+Y_1^j)$ may be dominant in a signal $X_0^j$ or a signal $X_3^j$, and a characteristic of a signal $(Y_3^j+Y_4^j)$ may be dominant in a signal $X_1^j$ or a signal $X_3^j$.

A signal component $Y_2^j$ may be represented by dominant in a signal $X_2^j$.

An energy matching equation is applied to the candidate signals, and a signal having a maximal value is selected, from among the candidate signals, as a signal to be patched, that is, the optimal signal.

The process will be described with reference to the example in FIG. 2.

Figure 2:
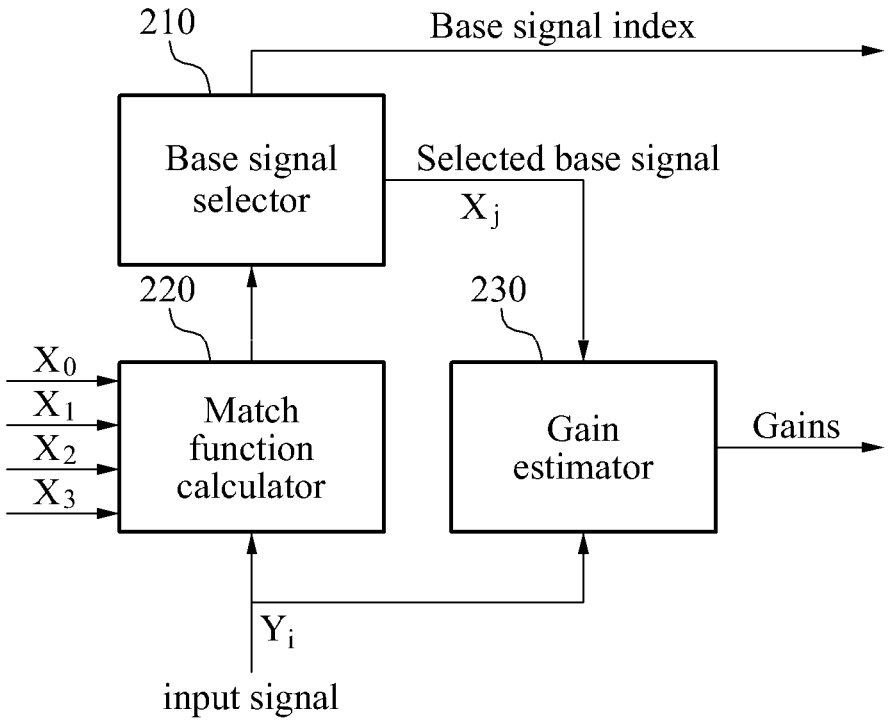
FIG. 2 is a diagram illustrating an example of a process that encodes a high-frequency signal in a multi-channel audio signal encoding apparatus.

FIG. 2 illustrates an example of a process that encodes a high-frequency signal in a multi-channel audio signal encoding apparatus.

Referring to FIG. 2, the multi-channel audio signal encoding apparatus 100 selects an optimal patching channel signal from among channel signals generated from the channel decorrelator 140 and extracts a parameter to be used for generating a high frequency signal.

A match function calculator 220 receives the generated channel signals $X_0^j$, $X_1^j$, $X_2^j$, and $X_3^j$, and calculates a matching function value of each of the signals as expressed by Equation 4.

$$R(Y_s^j, X_k^j) = \frac{\left(\sum_i \log E(Y_{si}^j)\log E(X_{ki}^j)\right)^2}{\sum_i \log E(X_{ki}^j)\log E(X_{ki}^j)} \quad \text{[Equation 4]}$$

A signal having a maximal matching function value $R(Y_s^j, X_k^j)$ is determined as an optimal channel signal.

A base signal selector 210 selects a base signal based on Equation 5.

$$R(Y_0^j + Y_1^j, X_k^j) \rightarrow \max_{k=\{0,3\}} \quad \text{[Equation 5]}$$

$$R(Y_3^j + Y_4^j, X_k^j) \rightarrow \max_{k=\{1,3\}}$$

A gain estimator 230 generates information associated with gain values corresponding to envelopes of an SBR coding scheme with respect to high-frequency band signals of multi-channel audio input signals.

As an example, a gain value may be calculated based on an energy ratio of a signal to be patched with an original signal as expressed by Equation 6.

$$g_0 = \sqrt{\frac{E(Y_0^j)}{E(X_k^j)}} \quad \text{[Equation 6]}$$

$$g_1 = \sqrt{\frac{E(Y_1^j)}{E(X_k^j)}}$$

Referring again to FIG. 1, a bitmuxer 160 encodes the downmixed signal and the extracted parameter to generate a bit stream.

Figure 3:
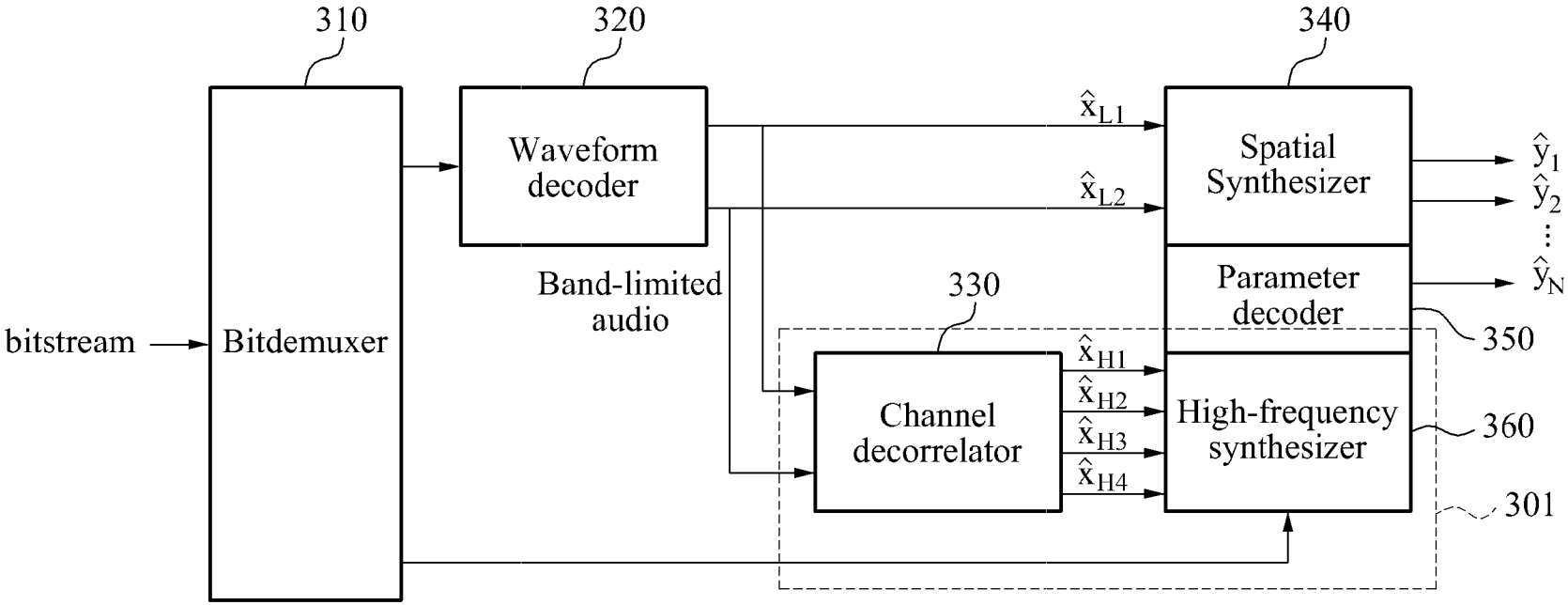
FIG. 3 is a diagram illustrating an example of a multi-channel audio signal decoding apparatus.

FIG. 3 illustrates an example of a multi-channel audio signal decoding apparatus. The multi-channel audio signal decoding apparatus may be implemented in a receiver.

Here, a multi-channel decoding process is performed in reverse order of the multi-channel encoding process described with reference to FIGS. 1 and 2.

First, a bitdemuxer 310 demuxes a transmitted bit stream.

A waveform decoder 320 decodes the waveform of the demuxed bit stream received from the bitdemuxer 310.

According to one example, multi-channel signals in a low frequency are restored using the transmitted downmixed signals and spatial parameters extracted by the spatial parameter extractor 120.

A spatial synthesizer 340 synthesizes multi-channel signals corresponding to a low frequency based on the downmixed signals and information associated with the spatial parameter.

The channel decorrelator 330 generates additional signals from the downmixed signals in the same manner as the multi-channel audio signal encoding apparatus 100 of FIG. 1, and may also generate base signal sets.

The multi-channel encoding process proceeds using the spatial synthesizer 340, the parameter decoder 350, the high-frequency synthesizer 360, and a multi-channel output voice signal that is similar to a multi-channel input voice signal. That is, an original signal may be generated.

Figure 4:
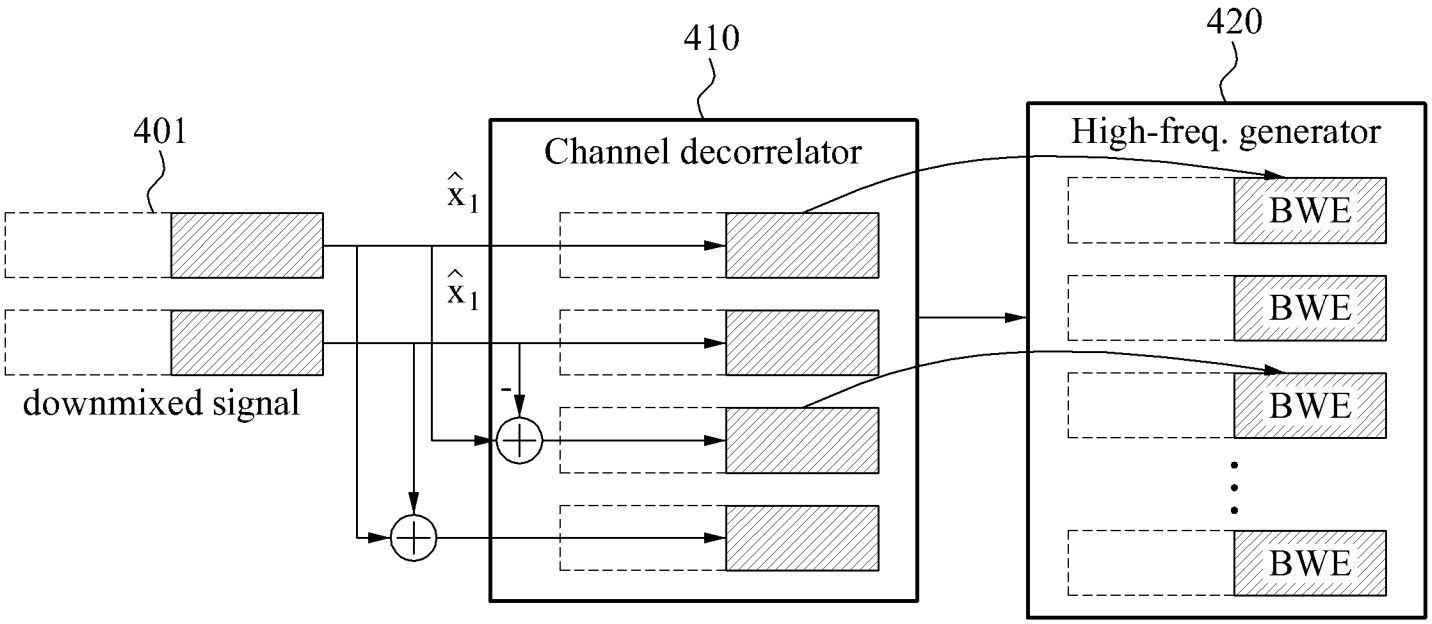
FIG. 4 is a diagram illustrating an example of a process that generates a high-frequency signal by patching a signal from a downmixed signal.

FIG. 4 illustrates an example of a process that generates a high-frequency signal by patching a signal from a downmixed signal.

In this example, a downmixed signal 401 is inputted to a channel decorrelator 410, and the channel decorrelator 410 generates an additional signal from a downmixed signal in the same manner as the multi-channel audio signal encoding apparatus 100 of FIG. 1 to generate a base signal set.

A high-frequency generator 420 selects a target signal to be patched from the base signal set based on patching channel index information, and may generate a high-frequency band signal based on generated gain information.

The multi-channel audio encoding apparatus may be implemented in a transmitter into which a multi-channel audio signal is input. As such, various aspects of the multi-channel audio encoding apparatus described above, for example, the downmixer, channel decorrelator, parameter estimator and bitmuxer, may be implemented in a transmitter as well. As noted above, and shown in FIG. 1, for example, the multi-channel audio encoding apparatus generates a bit stream to be transmitted.

The multi-channel audio decoding apparatus may be implemented in a receiver which receives a transmitted bit stream. As such, various aspects of the multi-channel audio decoding apparatus described above, for example, the bitdemuxer, parameter decoder, channel decorrelator, high-frequency signal synthesizer and spatial synthesizer, may be implemented in the receiver as well.

The transmitted and receiver may be implemented in various electronic devices.

The processes, functions, methods and/or software described herein may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules that are recorded, stored, or fixed in one or more computer-readable storage media, in order to perform the operations and methods described above, or vice versa. In addition, a computer-readable storage medium may be distributed among computer systems connected through a network and computer-readable codes or program instructions may be stored and executed in a decentralized manner.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A multi-channel audio signal encoding apparatus, the apparatus comprising:

a downmixer configured to downmix multi-channel audio input signals;

a channel decorrelator configured to expand the number of channels of the downmixed signals, thereby providing expanded channel signals;

a parameter estimator configured to select a signal from among the downmixed signals and expanded channel signals and to extract a parameter indicating a characteristic relation between the selected signal and the multi-channel audio input signals; and a bitmuxer configured to encode the downmixed signals and the extracted parameter.

2. The apparatus of claim 1, wherein the channel decorrelator expands the number of channels of the downmixed signals through linear combination or decorrelation.

3. The apparatus of claim 1, wherein the bitmuxer encodes the extracted parameter and a signal associated with a high frequency band signal of the multi-channel audio input signals within the downmixed signals.

4. The apparatus of claim 1, wherein the parameter estimator selects, from among the downmixed signal and the expanded channel signal, at least one signal having a maximal value when a match function is applied to the downmixed signal and the expanded channel signal with each input signal of the multi-channel audio input signal, and extracts a parameter indicating a characteristic relation between the selected signal and the multi-channel audio input signal.

5. A multi-channel audio signal decoding apparatus, the apparatus comprising:

a bitdemuxer configured to generate, from an input bitstream that is obtained by encoding a multi-channel audio signal, downmixed signals by demultiplexing the input bitstream;

a parameter decoder configured to decode, from the input bit stream, a parameter to be used for restoring a channel signal included in the multi-channel audio signal;

a channel decorrelator configured to expand the number of channels of the restored downmixed signals;

a high-frequency signal synthesizer configured to select, from the downmixed signals of which the number of channels is expanded, the channel signal to be patched using the decoded parameter; and a spatial synthesizer configured to restore the channel signal included in the multi-channel audio signal using the selected channel signal and the decoded parameter.

6. The apparatus of claim 5, wherein the channel decorrelator expands the number of channels of the downmixed signals, through linear combination or decorrelation.

7. A multi-channel audio signal encoding method of a transmitter, the method comprising:

downmixing multi-channel audio input signals;

expanding the number of channels of the downmixed signals;

selecting a signal from among the expanded channel signals;

extracting a characteristic relation between the selected signal and the multi-channel audio input signals; and encoding the downmixed signals and the extracted parameter.

8. The method of claim 7, wherein the expanding comprises expanding the number of channels of the downmixed signals through linear combination or decorrelation.

9. The method of claim 7, wherein the encoding comprises encoding the extracted parameter and a signal associated with a high frequency band signal of the multi-channel audio input signals within the downmixed signals.

10. The method of claim 7, wherein the selecting and extracting comprises:

selecting, from among the downmixed signals and the expanded channel signals, a signal having a maximal value when a match function is applied to the downmixed signals and the expanded channel signals with each input signal of the multi-channel audio input signals; and extracting the parameter indicating a characteristic relation between the selected signal and the multi-channel audio input signals.

11. A multi-channel audio signal decoding method of a receiver, the method comprising:

demultiplexing, from an input bitstream that is obtained by encoding a multi-channel audio signal, downmixed signals;

decoding, from the input bitstream, a parameter to be used for restoring a channel signal included in the multi-channel audio signal;

expanding the number of channels of the downmixed signals;

selecting, from the downmixed signals of which the number of channels is expanded, the channel signal to be patched using the decoded parameter; and restoring the channel signal included in the multi-channel audio signal using the selected channel signal and the decoded parameter.

12. The method of claim 11, wherein the expanding comprises expanding the number of channels of the downmixed signals through linear combination or decorrelation.

13. A non-transitory computer readable storage medium storing a program to implement the method of claim 7.

* * * * *